United States Patent [19]

Woodard, Jr. et al.

[11] 4,115,237

[45] Sep. 19, 1978

[54] ELECTROLYTIC CELL HAVING MEMBRANE ENCLOSED ANODES

[75] Inventors: Kenneth E. Woodard, Jr.; Steven J. Specht, both of Cleveland, Tenn.

[73] Assignee: Olin Corporation, New Haven, Conn.

[21] Appl. No.: 756,313

[22] Filed: Jan. 3, 1977

[51] Int. Cl.[2] ..... C25B 1/16; C25B 1/26; C25B 11/03; C25B 13/02

[52] U.S. Cl. ..... 204/258; 204/252; 204/266; 204/282; 204/283

[58] Field of Search ..... 204/266, 253, 256, 258, 204/282, 283

[56] References Cited

U.S. PATENT DOCUMENTS

| | | | |
|---|---|---|---|
| 1,153,438 | 9/1915 | Norquist | 204/282 |
| 2,944,956 | 7/1960 | Blue et al. | 204/282 X |
| 3,431,193 | 3/1969 | Balej et al. | 204/283 X |
| 3,878,082 | 4/1975 | Gokhale | 204/282 X |
| 3,923,630 | 12/1975 | Argade et al. | 204/266 |
| 3,926,769 | 12/1975 | Gritzner | 204/266 |

*Primary Examiner*—Arthur C. Prescott

*Attorney, Agent, or Firm*—James B. Haglind; Donald F. Clements

[57] ABSTRACT

A membrane cell for the electrolysis of aqueous salt solutions is provided in which the foraminous metal anode is enclosed in the membrane. Spacing means are provided to separate the portions coated with an electrocatalytically active material from the membrane. The spacing means may be a nonconducting material or the coated surface of the anode may be faced away from the membrane to permit the anode structure to serve as the spacing means. To provide a low cell voltage and permit efficient hydrogen gas release from the caustic solution, the cathode is spaced apart from the membrane.

12 Claims, 4 Drawing Figures

ELECTROLYTIC CELL HAVING MEMBRANE ENCLOSED ANODES

In the production of alkali metal hydroxides in diaphragm-type electrolytic cells, materials having ion-exchange properties are now available for use as membranes which are capable of producing solutions having a high concentration of alkali metal hydroxides. Production of these concentrated solutions in commercial diaphragm-type electrolytic cells currently available requires, however, high cell voltages and results in increased power costs in operating the cells.

It has been customary to place the membrane on the cathode so that there is little or no space between the membrane and the cathode. This arrangement impedes the release of hydrogen bubbles formed at the cathode.

U.S. Pat. No. 3,984,303, issued to E. J. Peters and J. E. Loeffler, Jr., describes a cell having a series of individual units in which a hollow cylindrical cathode is concentrically arranged around a hollow cylindrical anode. The anode has a tubular ion permeable membrane covering its outer surface. While removing the membrane from the cathode, the concentric electrodes are limited in size, expensive to fabricate and cell operation would result in high energy costs.

Therefore it is an object of the present invention to provide a membrane cell having improved hydrogen release capabilities.

Another object of the present invention is to provide a membrane cell having reduced energy costs while producing concentrated alkali metal hydroxide solutions.

A further object of the present invention is to provide a membrane cell which permits an enlarged space between the cathode and the membrane while reducing the cell voltage.

An additonal object of the present invention is a membrane cell in which the anode is spaced apart from the membrane by spacing means which prevent contact between the electrochemically active portions of the anodes and the membrane.

Another object of the present invention is a membrane cell which employs conventional electrode structures.

These and other objects of the present invention are accomplished in a cell for the electrolysis of alkali metal chloride brine which comprises an anode section having a plurality of self-contained anode compartments positioned in parallel and spaced apart from each other, the anode compartments comprising a foraminous metal anode, the anode having an electrocatalytically coated portion, an ion permeable membrane enclosing the anode, and spacing means interposed between the electrocatalytically coated portion of the anode and the ion permeable membrane; a cathode, section comprising a plurality of foraminous metal cathodes the cathodes being interleaved between adjacent anodes, the cathodes being spaced apart from the ion permeable membranes; means for introducing said alkali metal chloride brines into the anode compartments and means for removing chlorine gas and spent alkali metal chloride brine from the anode compartments, a cell body for housing the anode section and the cathode section, and means for removing hydrogen gas and alkali metal hydroxide solutions from the cell body.

Accompanying FIGS. 1–4 illustrate the present invention. Corresponding parts have the same numbers in all Figures.

Apparatus described in FIGS. 1–4 when used to electrolyze aqueous solutions of alkali metal chloride forms chlorine gas, hydrogen gas and an alkali metal hydroxide liquor. However, those skilled in the art will recognize that modifications can be made for the use of other starting materials to produce other products.

Figure 1:
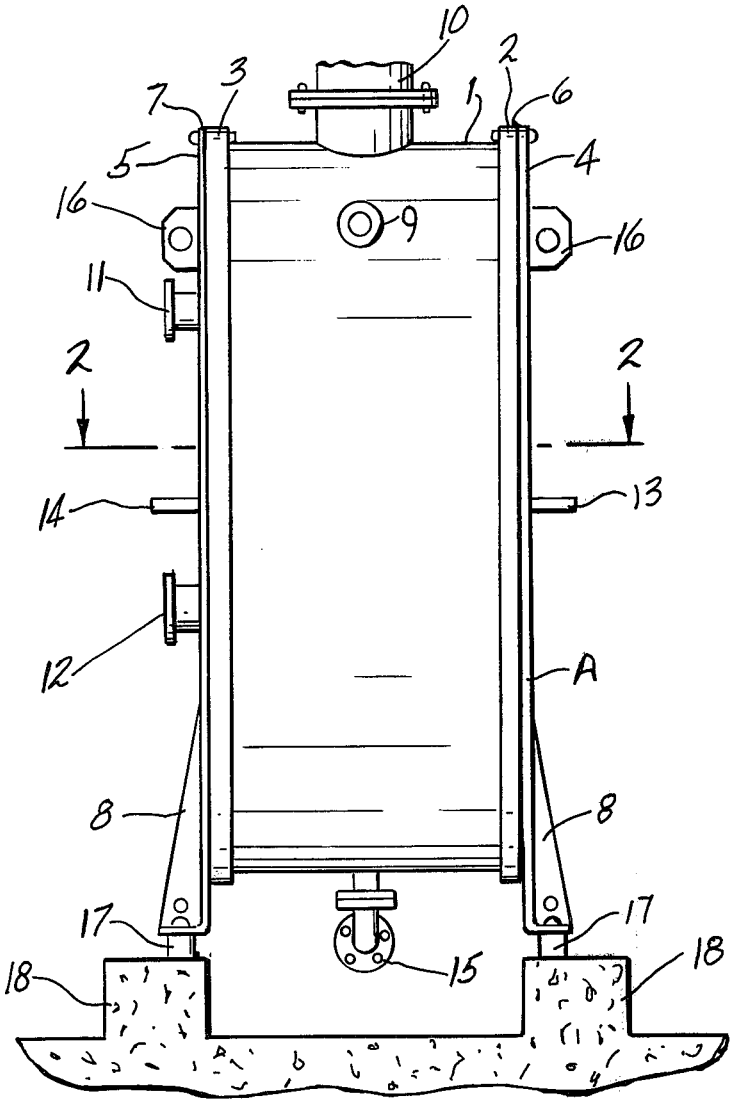
FIG. 1 illustrates a side view of one embodiment of the membrane cell of the present invention.

More in detail, FIG. 1 is a side view illustrating membrane cell A having a generally cylindrical cell body 1 and having flanges 2 and 3 surrounding each opening at the ends of cell body 1. Cathode plate 4 is attached to flange 2 at one end of cell body 1 and anode plate 5 is attached to flange 3 at the other end of cell body 1. Gaskets 6 and 7 seal cathode plate 4 to flange 2 and anode plate 5 to flange 3, respectively.

An aqueous alkali metal chloride solution to be electrolyzed enters through brine inlet 12 housed in anode plate 5. Chlorine gas and spent alkali metal chloride solutions are removed through outlet 11, and hydrogen gas is removed through outlet 10. Electric current is introduced to the cell through conductor 14 attached to anode plate 5. Current is removed from the cell at conductor 13 attached to cathode plate 4.

The cell is supported by plate supports 8 which are bolted or otherwise attached to insulators 17 resting on platforms 18.

Inlet 9 permits a liquid to be introduced into the cell. Outlet 15 removes the alkali metal hydroxide solution from the cell. Lugs 16 aid in the removal of cathode plate 4 and anode plate 5, respectively.

Figure 2:
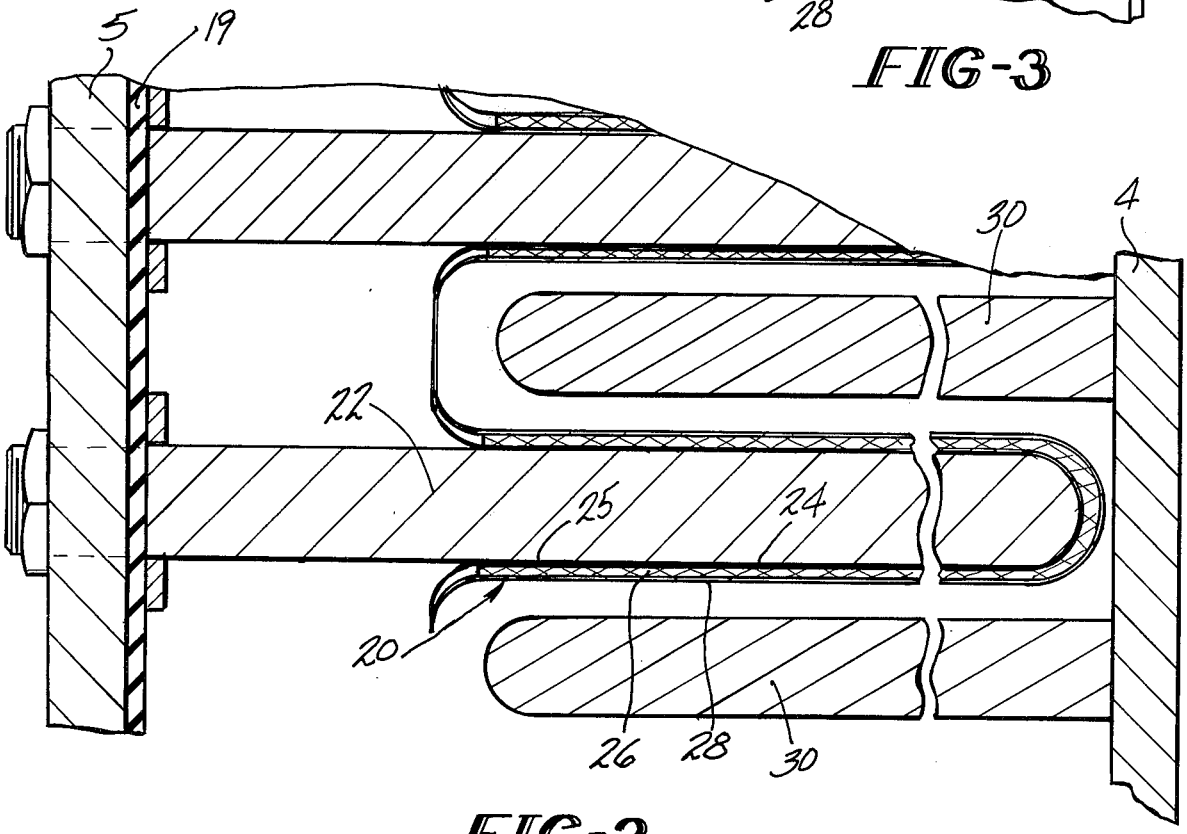
FIG. 2 represents a cross section taken along line 2—2 of FIG. 1.

In FIG. 2, anodes 20 comprise a foraminous metal surface 24 having an electroconductive electrocatalytic coating 25 on the outer side. Conductor 22 is welded along the side of foraminous metal surface 24. Separator 26 contacts coated portion 25 of foraminous electrode surface 24 and spaces coated portion 25 from membrane 28 which encloses separator 26 and anode 20. Anode 20 is bolted to anode plate 5 as shown. Cathodes 30, spaced apart from the sides of anode 20, are attached to the cathode plate 4.

Figure 3:
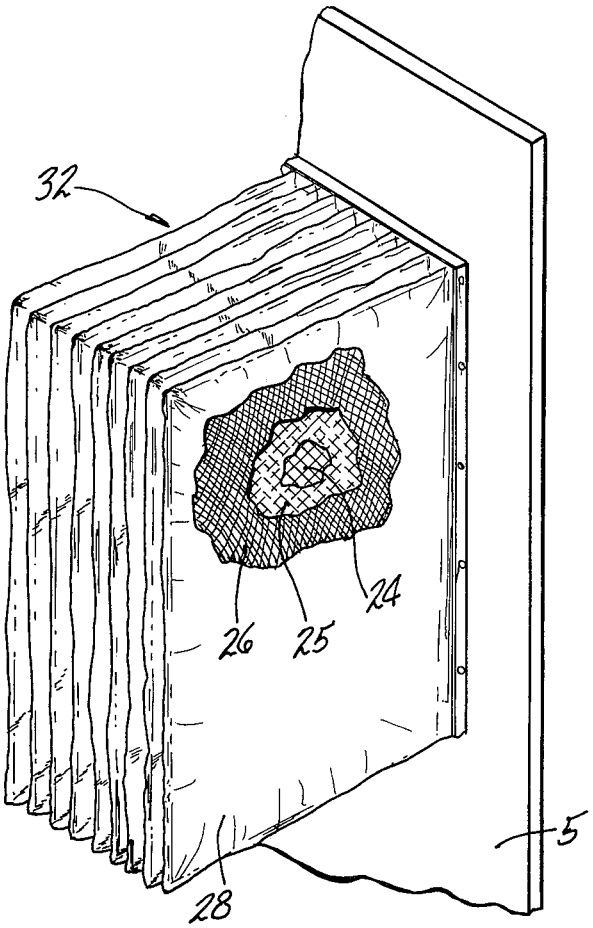
FIG. 3 illustrates a side view in perspective of an embodiment of the anode section of the present invention.

As shown in FIG. 3, a plurality of anodes are individually attached to anode plate 5 to form anode section 32.

Figure 4:
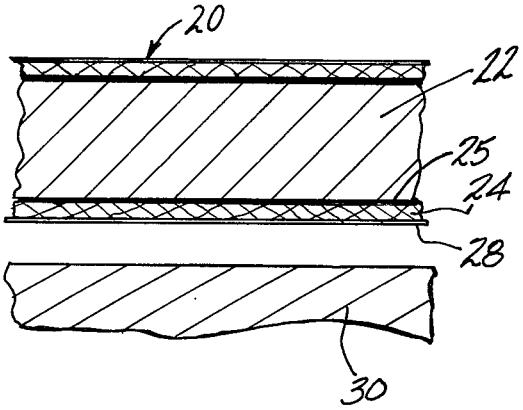
FIG. 4 represents an exploded partial section of another embodiment of the membrane enclosed anode of the present invention.

An additional embodiment of the membrane enclosed anode of the present invention is illustrated in FIG. 4. Anode 20 comprises foraminous metal surface 24 having an electrocatalytic coating 25 on its inner side. Also attached to the side of foraminous metal surface 24 is conductor 22. Membrane 28 contacts the outer side of foraminous metal surface 24 and is separated from electrocatalytic coating 25. Membrane 28 encloses anode 20 and is spaced apart from cathode 30.

The membrane enclosed anode used in the cell of the present invention includes a foraminous metal structure at least a portion of which is coated with an electroconductive, electrocatalytically active material. Suitable metals of which the anodes are composed include a valve metal such as titanium or tantalum or metals such as steel, copper, or aluminum clad with a valve metal. Over at least a part of the surface of the valve metal is a thin coating of an electrocatalytically active material such as a platinum group metal, platinum group metal oxide, an alloy of a platinum group metal, or a mixture thereof. The term "platinum group" as used in this specification means an element of the group consisting of ruthenium, rhodium, palladium, osmium, iridium, and platinum.

The foraminous metal structure can be in various forms, such as a perforated plate or sheet, mesh or screen, or as an expanded metal. The anodes have a planar surface which contains openings, suitably sized to permit the flow of fluids through the anode surface. The foraminous metal structure has a thickness of from about 0.03 to about 0.10, and preferably from about 0.05 to about 0.08 of an inch.

In a suitable example, the anode is comprised of two foraminous screens which are spaced apart to provide for passage of halogen gas and anolyte and to enclose conductive supports which supply electrical current. The screens are closed along the top, bottom and front edges to form a self-contained compartment.

The foraminous metal anode structures are attached to an anode plate by means of conductive supports such as rods which supply electrical energy to the electrochemically active surfaces. The anode plate is wholly or partially constructed of electroconductive materials such as steel, copper, aluminum, titanium, or a combination of these materials. Where the electroconductive material can be attacked by the alkali metal chloride brine or chlorine gas, it is suitably covered with a chemically inert material.

The electrocatalytically coated portions of the foraminous metal anode structure are prevented from adhering to the membrane by a spacing means. Direct contact between the membrane and electrocatalytically coated portions results in the loss of current efficiency and when using a platinum group coating, can result in an increased rate in the loss or removal of the platinum group component from the electrode surface.

In one embodiment, the spacing means is, for example, a screen or net suitably composed of any non-conducting chlorine-resistant material. Typical examples include glass fiber, asbestos filaments, plastic materials, for example, polyfluoroolefins, polyvinyl chloride, polypropylene and polyvinylidene chloride, as well as materials such as glass fiber coated with a polyfluoroolefin, such as polytetrafluoroethylene.

Any suitable thickness for the spacing means may be used to provide the desired degree of separation of the anode surface from the diaphragm. For example, spacing means having a thickness of from about 0.003 to about 0.125 of an inch may be suitably used with a thickness of from about 0.010 to about 0.080 of an inch being preferred. Any mesh size which provides a suitable opening for brine flow between the anode and the membrane may be used. Typical mesh sizes for the spacing means which may be employed include from about 0.5 to about 20 and preferably from about 4 to about 12 strands per lineal inch. The spacing means may be produced from woven or non-woven fabric and can suitably be produced, for example, from slit sheeting or by extrusion.

While it is not required, if desired, the spacing means may be attached to the anode surfaces, for example, by means of clamps, cords, wires, adhesives, and the like.

In another embodiment, the spacing means is the foraminous metal anode structure itself. As illustrated in FIG. 4, the surface of the foraminous metal structure which is coated with the electrocatalytic material is positioned so that it faces away from the membrane. The membrane contacts the uncoated surface of the foraminous metal structure. The coated portion of the foraminous metal anode is spaced apart from the membrane by a distance which is equal to the thickness of the foraminous metal structure. This distance, as cited above, is from about 0.03 to about 0.10, and preferably from about 0.05 to about 0.08 of an inch.

Enclosing the foraminous metal anode structures and the spacing means is a membrane composed of an inert, flexible material having cation exchange properties and which is impervious to the hydrodynamic flow of the electrolyte and the passage of chlorine gas and chlorine ions. A preferred membrane material is a perfluorosulfonic acid resin membrane composed of a copolymer of a polyfluoroolefin with a sulfonated perfluorovinyl ether. The equivalent weight of the perfluorosulfonic acid resin is from about 900 to about 1600, and preferably from about 1100 to about 1500. The perfluorosulfonic acid resin may be supported by a polyfluoroolefin fabric. A composite membrane sold commercially by E. I. DuPont de Nemours and Company under the trademark "Nafion" is a suitable example of the preferred membrane.

In the membrane enclosed anode of the cell of the present invention, the membrane is obtained in tube or sheet form and sealed, for example, by heat sealing, along the appropriate edges to form a casing or "envelope" which is open at only one end. This open end is pulled over the anodes to form an enclosed compartment. As illustrated in FIGS. 2 and 3, the anodes and cathodes are of the finger-type which are well known in commercial diaphragm-type electrolytic cells. A preferred type cell is that in which the finger-like electrodes are attached to vertically positioned electrode plates, as illustrated by U.S. Pat. No. 3,898,149, issued Aug. 5, 1975, to M. S. Kircher and E. N. Macken.

The open end of the membrane is then sealed to the anode plate, for example, by clamping as described in U.S. Pat. No. 3,980,544, issued to J. O. Adams, K. E. Woodard, Jr., and S. J. Specht.

The anode plate has suitable means for introducing alkali metal chloride brine into each of the self-contained anode compartments and has appropriate means for removing chlorine gas and depleted alkali metal chloride brine.

In the membrane enclosed anode of the cell of the present invention, the gap between the foraminous metal anode surface and the membrane is from about 0.003 to about 0.125 of an inch.

Spaced apart from the membrane enclosed anodes are cathodes which are positioned, as illustrated in FIG. 2, such that a cathode is interleaved between adjacent anodes. The cathodes are foraminous metal structures of metals such as steel, nickel or copper. The structures are preferably fabricated to facilitate the release of hydrogen gas from the catholyte liquor. It is preferable that the cathodes have an open area of at least about 10 percent, preferably an open area of from about 30 to about 70 percent, and more preferably an open area of from about 45 to about 65 percent.

As illustrated in FIG. 2, the space between the cathodes and the membrane is greater than the space between the anode surfaces and the membrane. In addition, this cathode-membrane gap is free of obstructing materials such as spacers, etc. to provide maximum release of hydrogen gas. The cathodes are spaced apart from the membranes a distance of from about 0.040 to about 0.750, and preferably from about 0.060 to about 0.500 of an inch. It is surprising that, in producing alkali metal hydroxide solutions containing at least about 30 percent by weight of the alkali metal hydroxide, an increase in the cathode-membrane gap results in a decrease in cell voltage. The cathodes are attached to a cathode plate which is positioned so that the cathodes are interleaved with the membrane enclosed anode compartments, as shown in FIG. 2. The cathode compartment is the entire area of the cell body which is not occupied by the membrane enclosed anodes, and provides a voluminous section for hydrogen gas release from the alkali metal hydroxide.

The cathode structures employed in the membrane cell of the present invention may have electrocatalytically active coatings similar to those used on the anodes. They may also be coated with metals such as nickel or alloys thereof.

To further illustrate the cell of the present invention, the following examples are presented. All parts and percentages are given by weight unless otherwise specified.

EXAMPLE

A cell of the type illustrated in FIG. 1 was equipped with a plurality of titanium mesh anodes having portions covered by a coating having ruthenium dioxide as the electroactive component. A fiber glass open fabric coated with polytetrafluoroethylene and having a thickness of 0.035 of an inch was placed over the mesh anode. The anode mesh and surrounding fabric were enclosed in a perfluorosulfonic acid resin membrane having an equivalent weight of 1200. The membrane was heat sealed to form a casing which was placed over the anode structure and clamped to the anode plate to provide a self-contained compartment. Intermeshed with the anodes were steel screen cathodes having an open area of about 45 percent. The cathodes were spaced apart from the membrane about 0.50 of an inch to provide an unobstructed hydrogen release area. Sodium chloride brine having a concentration of about 300 grams per liter of NaCl and at a temperature of 86° C. was fed to each of the anode compartments. Sufficient electrical energy was supplied to the cell to provide a current density of 2 $KA/m^2$ to produce sodium hydroxide liquor in the cathode compartment containing about 400 grams per liter of NaOH at a cell voltage of 3.5 volts. Hydrogen release from the caustic solution was excellent as was the release of chlorine gas from the brine in the membrane enclosed anodes.

Comparative Test

The Example was repeated with the only change being the placing of the membrane against the cathodes to eliminate the space between the cathode and the membrane. Sodium hydroxide liquor was produced containing about 400 grams per liter. The cell voltage, however, increased to 3.7 volts. This increase was due to the poor release of hydrogen gas from the caustic solution in the absence of a membrane-cathode gap.

What is claimed is:

1. A membrane cell for the electrolysis of alkali metal chloride brines which comprises:

(a) an anode section having a plurality of self-contained anode compartments positioned in parallel and spaced apart from each other, said anode compartments comprising a foraminous metal anode, said anode having an electrocatalytically coated portion, an ion permeable membrane enclosing said anode, and spacing means interposed between said electrocatalytically coated portion of said anode and said ion permeable membrane;

(b) a cathode section comprising a plurality of foraminous metal cathodes, said cathodes being interleaved between adjacent anodes, said cathodes being spaced apart from said ion permeable membranes;

(c) means for introducing said alkali metal chloride brines into said anode compartments and means for removing chlorine gas and spent alkali metal chloride brines from said anode compartments;

(d) a cell body for housing said anode section and said cathode section, and (e) means for removing hydrogen gas and alkali metal hydroxide solutions from said cell body.

2. The membrane cell of claim 1 in which said spacing means is a screen or net comprised of a material selected from the group consisting of glass fibers, asbestos filaments, plastic materials selected from the group consisting of perfluoroolefins, polyvinyl chloride, polypropylene, polyvinylidene chloride, and glass fibers coated with said plastic materials.

3. The membrane cell of claim 1 in which said membrane is composed of a perfluorosulfonic acid resin having an equivalent weight of from about 900 to about 1600.

4. The membrane cell of claim 3 in which said membrane is composed of a perfluorosulfonic acid resin supported by a polyfluoroolefin fabric.

5. The membrane cell of claim 1 in which said cathodes are spaced apart from said membranes a distance of from about 0.040 to about 0.750 of an inch.

6. The membrane cell of claim 2 in which said spacing means has a thickness of from about 0.003 to about 0.125 of an inch.

7. The membrane cell of claim 1 in which said cathodes are spaced apart from said membranes a distance greater than that separating said membranes from said anodes.

8. The membrane cell of claim 6 in which said cathodes are spaced apart from said membrane a distance of from about 0.060 to about 0.500 of an inch.

9. The membrane cell of claim 6 in which said spacer means is a net comprised of glass fibers coated with a polyfluoroolefin.

10. The membrane cell of claim 1 in which said foraminous metal anode is comprised of two foraminous structures which are spaced apart, each of said structures having a portion coated with an electroconductive, electrocatalytically active material, said anode being positioned with said electrocatalytically coated portion facing away from said membrane.

11. The membrane cell of claim 10 in which said foraminous metal anodes comprise a structure having a thickness of from about 0.03 to about 0.10 of an inch, said structure comprising said spacing means between said anode and said membrane.

12. The membrane cell of claim 10 in which said cathodes are spaced apart from said membranes a distance of from about 0.040 to about 0.750 of an inch.

* * * * *